US009161424B2

(12) United States Patent
Hechtfischer

(10) Patent No.: US 9,161,424 B2
(45) Date of Patent: Oct. 13, 2015

(54) SPOT MODE OPERATION FOR A DISCHARGE LAMP

(71) Applicant: KONINKLIJKE PHILIPS N.V., Eindhoven (NL)

(72) Inventor: Ulrich Hechtfischer, Aachen (DE)

(73) Assignee: Koninklijke Philips N.V., Eindhoven (NL)

( * ) Notice: Subject to any disclaimer, the term of this patent is extended or adjusted under 35 U.S.C. 154(b) by 0 days.

(21) Appl. No.: 14/360,326

(22) PCT Filed: Nov. 15, 2012

(86) PCT No.: PCT/IB2012/056433

§ 371 (c)(1),
(2) Date: May 23, 2014

(87) PCT Pub. No.: WO2013/080076

PCT Pub. Date: Jun. 6, 2013

(65) Prior Publication Data

US 2014/0333202 A1 Nov. 13, 2014

Related U.S. Application Data

(60) Provisional application No. 61/563,882, filed on Nov. 28, 2011.

(51) Int. Cl.

| | |
|---|---|
| ***H05B 39/00*** | (2006.01) |
| ***H05B 41/295*** | (2006.01) |
| ***H05B 41/04*** | (2006.01) |
| ***H05B 41/38*** | (2006.01) |

(52) U.S. Cl.

CPC ..... *H05B 41/388* (2013.01); *H05B 41/295* (2013.01); *H05B 41/382* (2013.01)

(58) Field of Classification Search

CPC ..... H05B 41/295; H05B 41/046; H01J 1/135

USPC ..... 315/105, 94

See application file for complete search history.

(56) References Cited

U.S. PATENT DOCUMENTS

2005/0206326 A1* 9/2005 Suzuki et al. ..... 315/246
2009/0230870 A1 9/2009 Quazi (Continued)

2010/0128232
A1
*
5/2010
Kagata et al. ..... 353/85

2010/0194302
A1

8/2010
Nakada et al.

FOREIGN PATENT DOCUMENTS

EP 0825808 A2 2/1998
EP 2211593 A2 7/2010

(Continued)

OTHER PUBLICATIONS

H. Pursch et al; "Arc Attachment and Falll Voltage on the Cathode of an AC High-Pressure Mercury Discharge", Journal of Phys. vol. 35, 2002, pp. 1757-1760.

*Primary Examiner* — Dylan White

(57) ABSTRACT

A lighting device and a method for operating a discharge lamp are described. In one embodiment, the discharge lamp comprises a sealed discharge vessel and two electrodes to produce an arc. A driver circuit delivers electrical power to the electrodes. In a run-up interval, electrical power is supplied as an alternating current IL. During the run-up interval, the waveform of the alternating current IL is changed at least once to a spot-enforcing waveform in order to change the mode of attachment of the arc to the electrodes to spot mode.

15 Claims, 9 Drawing Sheets

(56) References Cited

U.S. PATENT DOCUMENTS

| | | | | |
|---|---|---|---|---|
| 2011/0043771 | A1 | 2/2011 | Hirao | |
| 2011/0128508 | A1 * | 6/2011 | Yamada et al. | 353/85 |

FOREIGN PATENT DOCUMENTS

| | | |
|---|---|---|
| EP | 2242337 A2 | 10/2010 |
| WO | 0182658 A1 | 11/2001 |

* cited by examiner

SPOT MODE OPERATION FOR A DISCHARGE LAMP

CROSS-REFERENCE TO PRIOR APPLICATIONS

This application is the U.S. National Phase application under 35 U.S.C. §371 of International Application No. PCT/IB2012/056433, filed on Nov. 15, 2012, which claims the benefit of [e.g., U.S. Provisional Patent Application No. or European Patent Application No.] 61/563,882, filed on Nov. 28, 2011. These applications are hereby incorporated by reference herein.

TECHNICAL FIELD

The invention relates to a lighting device including a discharge lamp and to a method of operating a discharge lamp. In particular, the invention relates to a device and method for improving operation of a discharge lamp during run-up, i. e. in a time period of operation before the lamp has reached a thermally steady-state mode of operation.

BACKGROUND ART

Different types of arc discharge lamps are known, each comprising a sealed discharge vessel and at least two electrodes projecting into a sealed discharge space within the discharge vessel. An arc discharge lamp generates light from an electrical arc ignited between the electrodes. According to the type of lamp, there may be different components provided within the discharge vessel, in particular a filling gas at a specified filling pressure and other ingredients such metal halides or, optionally, mercury.

Electrical power is supplied to the electrodes by a driver circuit. This may include a high voltage pulse for igniting a discharge between the electrodes. Typically, a discharge created will start as a glow discharge and quickly transit into an arc discharge.

For example, in an automotive HID lamp, i. e. a lamp intended for use in a headlamp of an automobile, electrical power is supplied to the electrodes as an alternating current. In the run-up period, after the electrical arc has been successfully established, known automotive HID lamps, e. g. with a nominal power of 35 W, are first operated by limiting the current to a maximum value. In a later stage of the run-up period, the lamp may be operated in a power control mode, according to a power curve, decreasing over a predetermined time from an initial higher power value to the nominal power value. Upon transition into steady-state operation, the electrical power supplied to the lamp as an alternating current, preferably as a square wave, is controlled at the nominal power of the lamp.

US 2009/0230870 describes an electronic ballast for high intensity discharge lamps. Formation of an arc is controlled by ignition control, glow-to-arc transition current control and initial arc development current control. The arc thus formed is stabilized in arc stabilization current control, followed by lamp power control during normal operation. During this period, an alternating current is supplied first at a higher switching frequency during an initial arc development stage and later at a constant, lower frequency during arc stabilization and normal operation. Before switching from the higher to the lower frequency, there is an increase of the voltage, lamp current and operating frequency.

DISCLOSURE OF INVENTION

It is an object of the present invention to provide a lighting device and a method for operating a discharge lamp which allow improved operation of a discharge lamp.

This object is solved by a lighting device according to claim 1 and a method according to claim 15. Dependent claims refer to preferred embodiments of the invention.

The invention is based on the idea to provide operating conditions such that the lamp is preferably operated in "spot mode", i. e. such that the mode of attachment of the electrical arc to the electrodes corresponds to a spot mode, where the arc is attached to the electrode only at a small location, rather than a diffuse mode, where the arc is attached to the electrode over a larger area of the electrode front. The spot mode has the advantage of lower electrode losses and therefore lower electrode temperatures, so that a higher luminous flux is generated at a given total lamp power. A further advantage is improved behavior in terms of electromagnetic interference (EMI), which is particularly important for automotive HID lamps. Based on the recognition of a hysteresis behavior, which will be explained in detail in connection with preferred embodiments, the invention proposes to switch a lamp to spot mode of arc attachment during the run-up phase in order to ensure operation in this mode also for the following steady-state operation.

According to the invention, this may be achieved by supplying electrical power within a run-up interval, defined as a specified time interval after ignition of the discharge lamp, as an alternating current supplied to the lamp, where during the run-up interval the waveform of the alternating current is changed at least once to a spot-enforcing waveform in order to change the mode of attachment of the arc to the electrode to spot mode.

As will be explained, the spot mode, once reached, is typically stable. In case that the lamp was already operating in spot mode before application of the spot-enforcing waveform, it will continue to operate in this mode. If, however, the lamp was operating in diffuse mode of arc attachment, the spot-enforcing waveform of the supplied operating current will likely succeed to switch the lamp from diffuse mode to spot mode arc attachment, which will then remain stable in the following operation.

Thus, the invention provides a very simple way of achieving a desired operation in spot mode, without requiring special measures during later steady-state operation.

According to preferred embodiments of the invention, the run-up interval, during which power is supplied as an alternating current, preferably as a square wave, and during which the spot-enforcing waveform is applied at least once, preferably multiple times, may be defined as the time between 1-100 seconds after ignition of the lamp. It may be possible to apply the spot-enforcing waveform successfully earlier than 5 seconds after ignition, but it is generally preferred to wait until the lamp operating conditions are sufficiently close to the final steady-state and the lamp components, in particular the electrodes, have reached sufficiently steady thermal conditions so that switching to spot mode is indeed permanent. Therefore, it is further preferred for the application of the spot-enforcing waveform to start at 10 seconds or later after ignition, and even further preferred 20 seconds or more after ignition. On the other hand, it is also possible to first apply the spot-enforcing waveform at a time later than 100 seconds after ignition and still achieve a stable spot mode then. However, in order to establish the spot mode as early as possible, it is preferred to start applying the spot-enforcing waveform e. g. earlier than 60 seconds after ignition, further preferred earlier than 40 seconds after ignition.

During steady-state operation following the run-up interval, electrical power is preferably supplied to the electrodes without further application of a spot-enforcing waveform. This facilitates operation and driver design. For example, after 200 s after ignition, the current is supplied in a regular square wave, without application of a spot-enforcing waveform.

According to preferred embodiments of the invention, different waveforms of the driving current may be used to enforce spot-mode arc attachment. As will be explained below, arc attachment in spot mode rather than diffuse mode occurs if the electrode as a whole is not sufficiently heated to sustain a diffusely attached arc. Consequently, a preferred spot-enforcing waveform comprises at least a portion with a current waveform effective for cooling one or both of the electrodes, i.e. where an electrode is driven as anode at a reduced current. As will become apparent from detailed embodiments described below, a cooling current waveform portion may be provided by a relatively long cooling interval, where operation is effected at a reduced current value. Alternatively, cooling may also be achieved by a plurality of consecutive shorter cooling intervals, establishing a lower electrode temperature.

The probability for achieving a spot-mode by a reduced current depends on how low the current is chosen and for how long. The lower the current, the higher the probability for achieving spot-mode. The lower limit for a reduced current is a current value where the lamp extinguishes. The reduced current level should thus be chosen above the minimum current value for sustaining an arc discharge but below the usual run-up current. Since the run-up current is not constant throughout the run-up interval, the current value of the reduced current should be lower compared to the momentary run-up current applied before the start of the spot-enforcing waveform.

Also, the probability of achieving spot-mode is higher the longer a reduced current is applied. However, applying a reduced current over a relatively long period of time will lead to a dip, or decrease of the luminous flux visible to the human eye. This may be acceptable for some applications. In particular for an automotive headlamp, it is preferred that the spot-enforcing waveform does not produce visible dips.

A particularly preferred effective spot-enforcing waveform provides first a cooling interval to cool an electrode and then a commutation with a following spot mode interval to switch the electrode to spot mode. During these intervals, the current supplied may be at least substantially constant (i.e., varying less than +/−10%), but it is alternatively also possible (and in many practical applications easier to obtain) to have the current vary within the cooling and spot mode intervals, e.g. as a current ramp.

During the cooling interval, electrical current is supplied to the electrode substantially constant, or alternatively with a varying current value at a first current level (or, in the case of a varying current: a first average current level) with a first polarity, so that a first electrode is operated as anode. The current level is preferably chosen relatively low. This leads to cooling of the anode electrode.

In a directly following spot mode interval, a current at a second current level (or: second average current level) is supplied with opposite polarity. The first electrode, previously cooled during the cooling interval, is now operated as cathode. If the first current level is chosen low enough and the time duration is chosen long enough, the electrode temperature will not be sufficient to sustain diffuse mode, and therefore switch to spot mode.

In some waveforms, that have proven to be effective as spot-enforcing, the absolute value of the second current level, demanded of the electrode after commutation, is chosen to be higher than the absolute value of the first current level supplied during the cooling interval. Experiments have shown that it is effective for the second current level to be at least 50% higher than the first current level, further preferred to be at least twice the first current level. Even better results have been obtained with even higher second current level, such as 5 times or more higher than the first current level. Again, the current supplied in the spot mode interval may be substantially constant, or may alternatively vary during the interval. In case of varying current values in the cooling and/or in the spot mode interval, the first and second current levels may be defined as time average values over each interval duration.

It is preferred to choose the spot-enforcing waveform such that the luminous flux generated by the lamp is not substantially changed, such that application of the spot-enforcing waveform should be hardly visible, and visible light dips are avoided. In order to achieve this, it is preferred that the first and second current level and the duration of the cooling interval and the spot mode interval during which they are applied are chosen to obtain a time average current which is within no more than +/−20% of the current that is applied to the lamp before and after the spot-enforcing waveform. During the run-up interval, the current supplied as an alternating, preferably rectangular current will change gradually as the discharge vessel heats up. Thus, the run-up current level applied may not be entirely constant, but will change only little during the short duration of the spot-enforcing waveform, which in the present context is referred to as "substantially constant". Preferably, the run-up current level applied before and after the spot-enforcing waveform and the average current supplied during the spot-enforcing waveform are within a +/−10%, further preferred within a +/−5% interval to avoid visible light dips.

According to embodiments of the invention, preferred spot-enforcing waveforms include a first type of waveforms applied once and a second type of waveforms applied multiple times in direct succession.

A spot-enforcing waveform to be applied once (i.e. once before reverting to regular run-up; in fact, the waveform may be applied repeatedly after a while) includes alternating constant or varying current level intervals. These intervals preferably comprise a first interval, where a current is supplied at a first current level and a first polarity and a following second interval, where the current is supplied at a second current level at opposite polarity. (Within these intervals, the current may be supplied at at least substantially constant current level, or alternatively varying current.) Again, the second average current level may be chosen higher than the first average current level (absolute value). The first and second intervals preferably each have a duration which is longer than a period of the alternating current supplied before and after the spot-enforcing waveform. In the run-up interval, as well as preferably also in later steady-state operation, the operating current is supplied at a relatively low frequency of e. g. 150-500 Hz, preferably 200-400 Hz. The above described spot-enforcing waveform of current intervals preferably has a total duration of more than 10 ms, further preferred at least 20 ms. In order to avoid long periods of different current levels, which will be visible in the light output of the lamp, it is preferred that the duration of the two intervals in sum is less than 100 ms, further preferred less than 60 ms. The duration of the first and second intervals is preferably chosen such that a quotient of the duration of the first interval to the sum of the first and second intervals is between 0.3 and 0.7, preferably at about 0.5, so that the two intervals have about equal duration.

The first current level is preferably chosen to be less than the run-up current level applied before and after the spot-enforcing waveform, and the second current level is preferably chosen higher than the run-up current level. Thus, luminous flux may remain about constant on the average.

In a further preferred embodiment of a spot-enforcing waveform, a current is supplied with different current levels in consecutive intervals. This type of spot-enforcing waveform is preferably repeated multiple times in direct succession.

In one example of spot-enforcing waveform, the current is supplied with different current levels in four consecutive intervals, a first current of first polarity in a first interval, second current at second polarity in a second interval, and third and fourth current levels in third and fourth intervals. Within each interval, the current level, if not at least substantially constant, may be defined as a time average value. The polarity of the current supplied in the first and second interval is the same and is opposite to the polarity of the current supplied in the third and fourth interval. In a further preferred embodiment, the absolute value of the first current level is higher than the absolute value of the second current level, and the absolute value of the third current level is higher than the absolute value of the fourth current level. (In the present context, when current levels are compared, reference is made to the absolute values thereof, ignoring polarity.)

This waveform, in particular if repeated in a succession of the four intervals multiple times, has been found to be effective as a spot-enforcing waveform, because as the current is reduced in the second interval, the electrode acting as anode cools down and, after commutation, has to deliver a current of opposite polarity in the following interval. This, as will be explained for preferred embodiments, is likely to switch the mode of arc attachment to spot mode for this electrode.

Preferably, in the first and fourth interval, the current level is varied to obtain less variation of the average current, and thus about constant light output. The higher first current level thus compensates for the lower second current level, and the lower fourth current level compensates for the third higher current level. Thus, this waveform is effective for avoiding noticeable dips in the luminous flux generated from the lamp.

Preferably, the above described waveform may be inserted into the AC (rectangular) current supplied during the run-up interval, so that the overall duration of all four intervals in sum is at least substantially equal to one period of the supplied AC current. Thus, the spot-enforcing waveform is supplied within a single period of the supplied operating current, which facilitates design of the driver circuit.

The first duty cycle, i. e. quotient of the duration of the first interval and the sum of durations of the first and second interval, as well as the second duty cycle, i. e. quotient of the duration of the third interval and the sum of durations of the third and fourth interval, may preferably be chosen e. g. between 25% and 75%. Higher or lower duty cycles may lead to undesirably high current level, or may not be sufficiently long to achieve the desired thermal behavior. Further preferred are duty cycles between 40% and 60%, especially preferred substantially 50%, so that all four intervals have substantially the same duration.

The first current factor, defined as the value of the first current level divided by the second current level, as well as the second current factor, defined as the third current level divided by the fourth current level, may e. g. be chosen between 1.5 and 10. Factors below 1.5 may not be efficient to achieve the transition. Too high factors will be difficult to implement in a driver circuit and may cause additional problems, such as commutation problems. Preferably, the first and second current factors may be chosen between 2 and 6.

Comparing the absolute values of the first to fourth current levels with the run-up current level applied before and after the spot-enforcing waveform, the first and third current level are preferably chosen higher than the run-up current level, and the second and fourth current levels are chosen lower than the run-up current level.

In a further preferred embodiment, a commutation frequency during the spot-enforcing waveform may differ from a commutation frequency applied in the run-up phase prior to (and preferably also after) application of a spot-enforcing waveform. In an example, the current is supplied during the spot-enforcing waveform with a lower commutation frequency than during the remaining run-up phase. This has proven particularly advantageous if a continuous modulation of the absolute value of the current is applied. According to a preferred embodiment, which has proven to the both effective for obtaining stable spot-mode without noticeable light-output dips and for relatively easy design of the driver circuit, the current during the spot-enforcing waveform is supplied as an alternating current with a certain commutation frequency, where the absolute value of the current is continuously modulated. Preferably, the modulation is symmetrical about a time average current value at least substantially equal to the time average current value applied during the run-up phase before application of the spot-enforcing waveform. In particular preferred is a modulation at a modulation frequency higher than the commutation frequency. Surprisingly, experiments have shown that a waveform with a modulation frequency different from the commutation frequency is effective to switch a lamp to spot-mode and easy to achieve with existing programmable driver circuits.

The proposed embodiment of a waveform is preferably symmetrical, such that both electrodes are equally affected and switched to spot mode.

It is possible to apply a spot-enforcing waveform only at a single time during the run-up interval. In order to ensure that the transition to spot mode will indeed occur, it is also possible, and preferred, to apply the spot-enforcing waveform at different times. Between application of the spot-enforcing waveforms, current is preferably supplied as an alternating current of constant frequency. For example a spot-enforcing waveform may be applied at least twice, preferably at least three times during the run-up interval. The spot-enforcing waveform may be applied a predetermined number of times and at predetermined points in time without modification. Alternatively, the application may be dependent on feedback obtained from the lamp, i.e. measurements to find out if transition to spot mode was successful. If the electrodes are still found to operate in diffuse mode, the spot-enforcing waveform may be applied again.

Further, in the case of a spot-enforcing waveform suitable for switching only one electrode to spot mode, it is preferred to apply, during the run-up interval, at least a first spot-enforcing waveform to switch a first electrode to spot mode and a second, reverse spot-enforcing waveform to also switch the second electrode to spot mode.

The device and method may be used for operation of very different types of arc discharge lamps, where operation in spot mode is preferred. In particular, the lamp may be a HID (high intensity discharge) lamp. The invention especially applies to automotive HID lamps, in particular with mercury-free filling. Since the presence of thorium within the discharge space, and in particular thoriated electrodes may promote spot mode operation, the invention especially applies to thorium-free arc discharge lamps.

The invention may advantageously be used in particular for lamps where the driver circuit is arranged within the lamp base. Generally, these lamps are designed to operate in steady-state at a nominal power of 20-30 W, in particular 25 W.

These and other aspects of the invention will be apparent some and elucidated with reference to the embodiments herein after.

BRIEF DESCRIPTION OF THE DRAWINGS

FIG. 4-11*a*, 11*b* show schematic timing diagrams of a lamp current with a spot-enforcing waveform according to a different embodiments;

DESCRIPTION OF EMBODIMENTS

Figure 1:
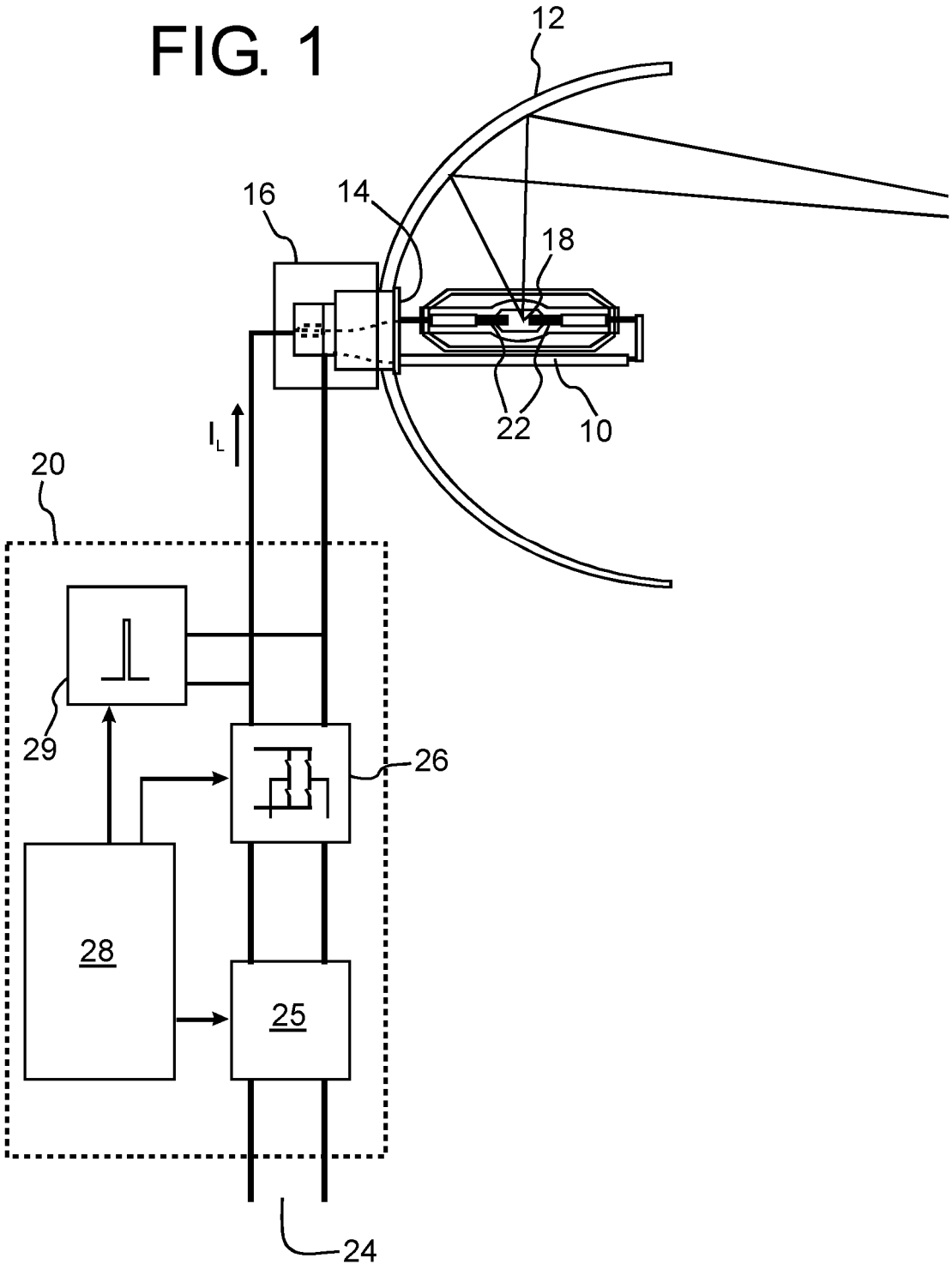
FIG. 1 shows a schematical representation of a lighting device including a discharge lamp and a driver circuit.

FIG. 1 shows schematically an arc discharge lamp 10, in the current example an automotive HID discharge lamp arranged within a front reflector 12 of an automobile. The lamp 10 comprises a base 14 received within a socket 16 comprising mechanical connections and electrical connections to a schematically shown driver circuit 20.

The lamp 10 comprises a discharge vessel defining a sealed inner discharge space 18 with electrodes 22 arranged opposite to each other. Contained within the discharge space is a rare gas, preferably xenon, and metal halides. Since HID lamps are per se known to the skilled person, further details of the design of the discharge lamp 10 need not be explained.

The driver circuit 20 is supplied, in the example shown, by a DC onboard voltage of the automobile at an input 24. The driver circuit 20 provides a lamp operating current $I_L$ to the socket 16, where electrical connections of the base 14 serve to apply the lamp operating current $I_L$ to the electrodes 22.

The structure of an exemplary driver circuit 20 is generally shown in FIG. 1. A controllable DC/DC-power supply 25 supplies a DC current to a full bridge switching unit 26. A control unit 28 controls the DC/DC supply 25 to provide a lamp current $I_L$ with a desired current level and also drives the switching unit 26 so supply the current $I_L$ at the desired frequency and polarity, i. e. as a square wave alternating current. During ignition, the control unit 28 drives an ignition circuit 29 to supply a high voltage pulse.

Figure 2:
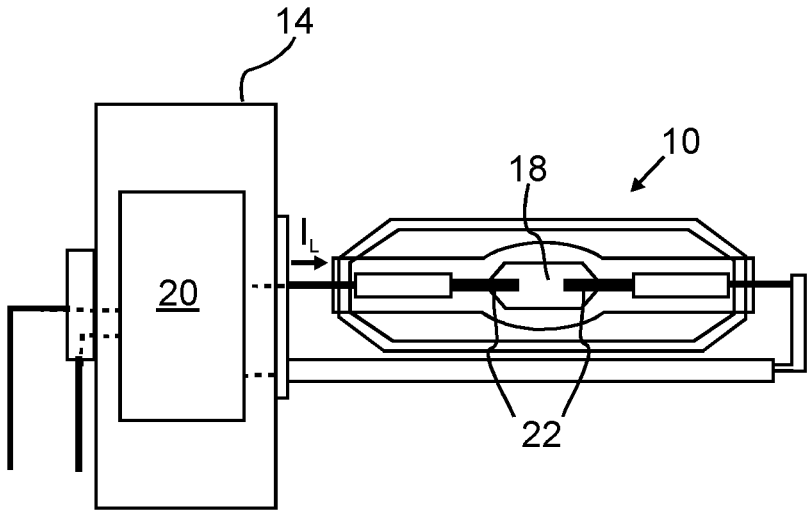
FIG. 2 shows a schematic representation of a discharge lamp with a driver circuit integrated into the base of the discharge lamp.

In a preferred alternative embodiment of a lamp 10 shown in FIG. 2, the driver circuit 20 is integrated within the base 14 of the lamp 10, so that the regular DC onboard voltage may be applied to electrical contacts as the base 14 and the thus supplied driver circuit 20 will generate the lamp current $I_L$ for supply to the electrodes 22.

As known to the skilled person, operation of the lamp 10 of FIG. 1 (as well as in the alternative embodiment of FIG. 2) will be effected by supplying a high voltage between electrodes 22 for igniting an arc discharge, and consequently supplying electrical power to the lamp 22 until steady-state operation at full luminous flux is reached. In steady-state, the lamp 10 is operated with a lamp current $I_L$ supplied as a square wave alternating current of relatively low frequency, e. g. 300 or 400 Hz.

During each half period of the lamp current $I_L$, one of the electrodes 22 operates as anode and the other as cathode of an arc discharge. An arc attachment mode describes how the electrical arc discharge is attached to the cathode. In the diffuse mode, an arc footprint is spread over a large part of the cathode front surface. In the spot mode, the electrical arc is attached to the cathode in constricted fashion only at a small spot. As described in "Arc Attachment and Fall Voltage on the Cathode of an AC high-pressure Mercury Discharge" by H. Pursch et al, J. Phys. D: Appl. Phys. 35 (2002) 1757-1760, the cathode tip in the spot mode has a higher temperature than in diffuse mode, however the remaining electrode body has a lower temperature in the spot mode.

Figure 7:
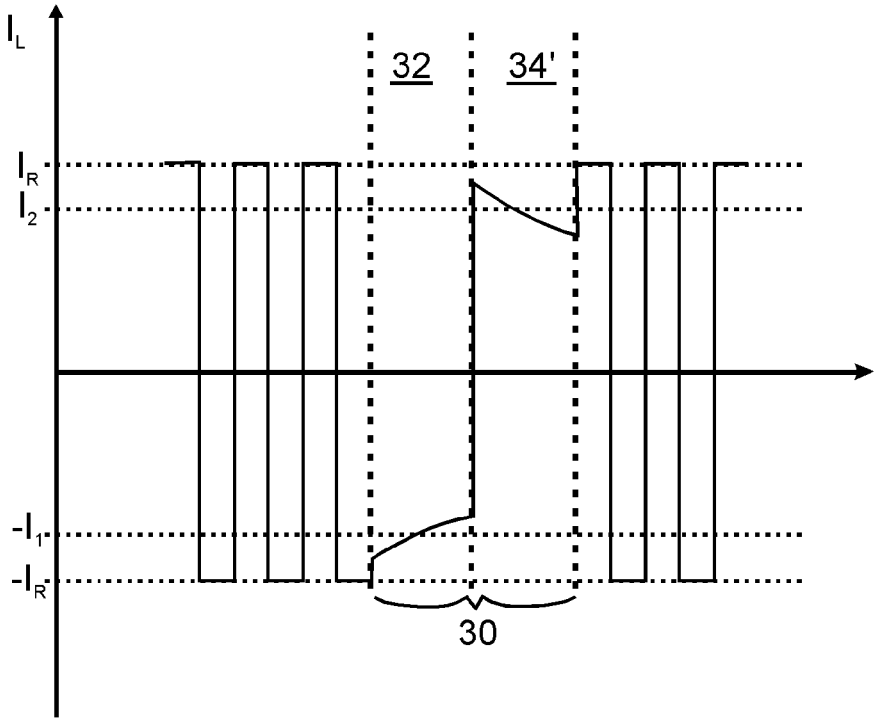
Figure 8:
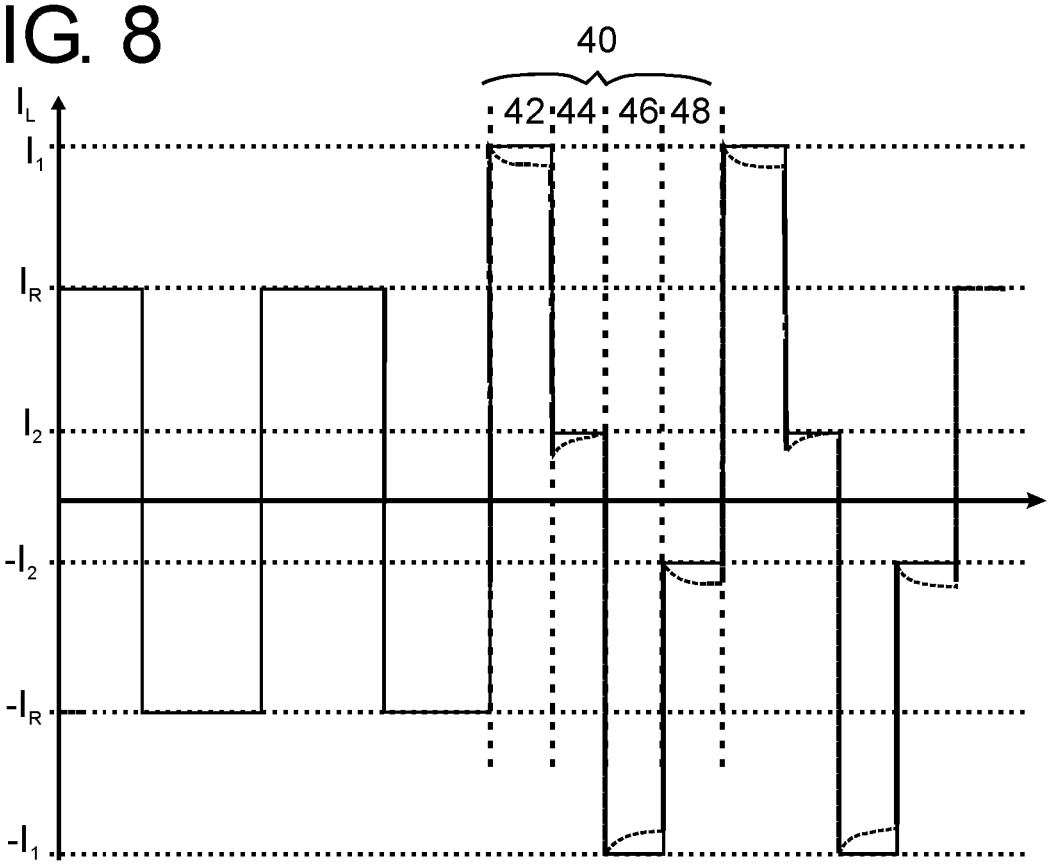

The mode of arc attachment to the cathode may depend on a plurality of parameters, out of which the lamp current $I_L$ and the salt pressure p are the most important. For this two-dimensional parameter space, FIG. 8 schematically shows the region of existence of the spot mode C, of the diffuse mode A, and a coexistence region B. As experiments have revealed, lamp operation in the spot mode region C, i. e. to the left of the dotted line of FIG. 7, will always be in spot mode. Likewise, operation in the diffuse-mode region A will always occur in diffuse mode. However, in the coexistence region B, the mode of operation shows a hysteresis behavior, i. e. it will depend on the previous mode of operation. This means, that within the coexistence region B the mode of arc attachment will remain stable unless parameters change so that operation passes into the region of the opposite mode.

Applying this knowledge to HID lamps, in particular in the automotive field, where operation in spot mode is preferred, a lamp should be designed and operated within the spot mode region C, or in the coexistence region B, but not in the diffuse mode region A. While in the diffuse mode region A a stable operation in spot mode may not be achieved, a lamp operating in coexistence region B in diffuse mode may be stably switched to spot mode by briefly changing parameters to enter the spot mode region C, even if parameters are then again changed back to coexistence region B.

Accordingly, it is possible for lamps with steady-state parameters in coexistence region B, or for series of lamps designed for spot mode region C, out of which some individual lamps due to manufacturing tolerances will operate in coexistence region B, to ensure spot mode operation by once switching the lamp to spot mode, which will be stable thereafter.

In order to effect this switching, a spot-enforcing waveform of the lamp current $I_L$ may be used. Since spot mode operation occurs if a cathode of relatively low temperature has to deliver a current, the basic idea of a spot-enforcing waveform is to operate an electrode to cool down. Cooling may be effected in particular by operating an electrode as anode at reduced current. If then commutation occurs and the electrode works as a cathode, the mode of arc attachment is likely to switch to spot mode.

Figure 4:
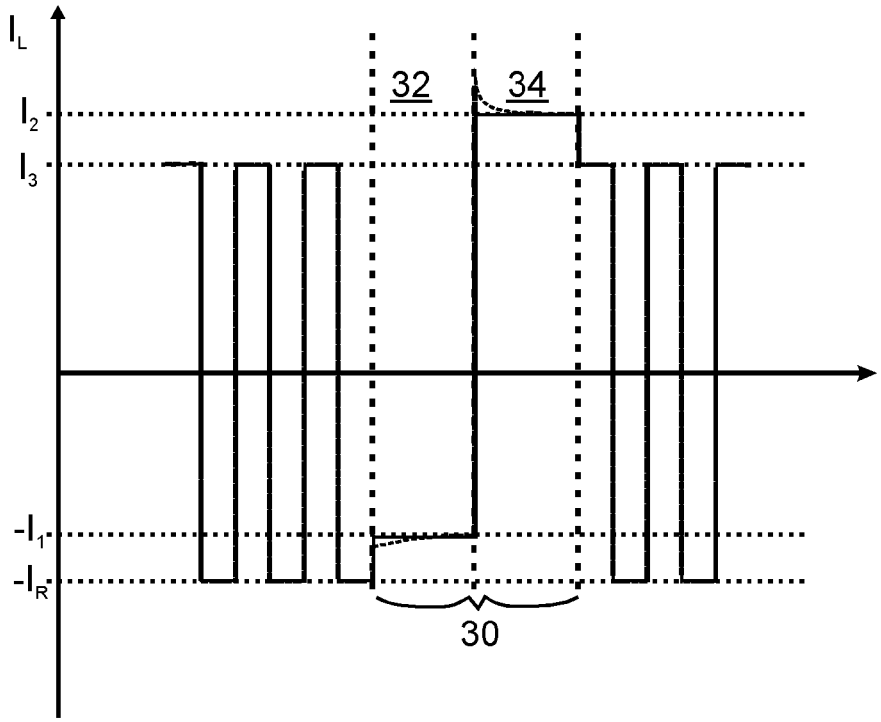
Figure 5:
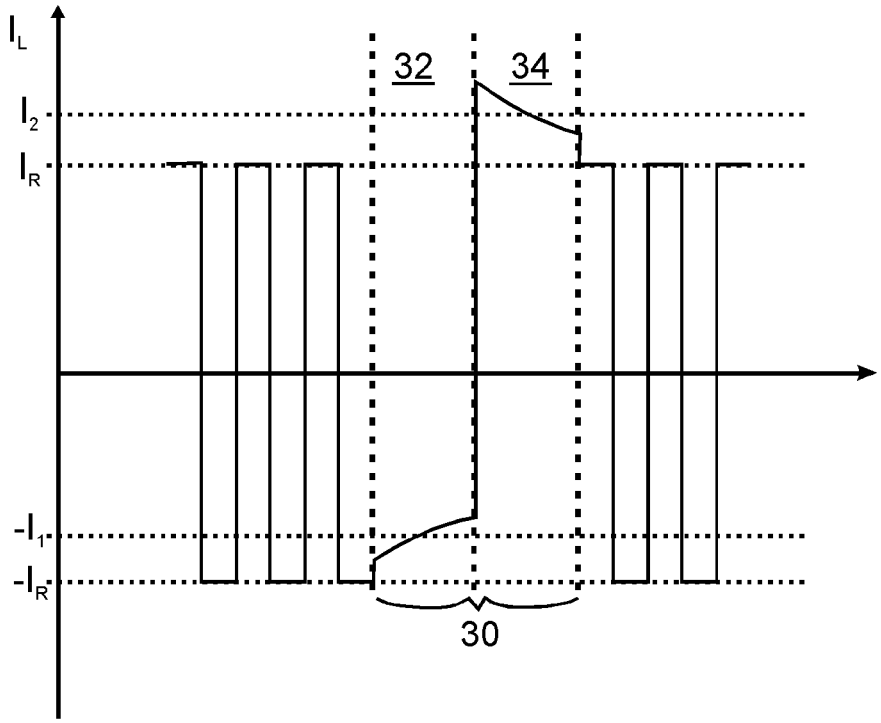

FIGS. 4 and 5 illustrate schematically examples of spot enforcing waveforms 30 of the lamp current $I_L$. These waveforms provide a cooling interval of relatively low current and a following spot-mode interval, where the lamp is operated at a relatively high current. For the first example shown in FIG. 4, an example of an ideal waveform is shown as a solid line. Before and after the spot-enforcing waveform 30, the lamp current $I_L$ is supplied as an alternating current of rectangular waveform commutated between current levels $I_R$ and $-I_R$. During the spot-enforcing waveform 30, the lamp current $I_L$ is supplied in a first cooling interval 32 as a direct current of reduced current level $-I_1$, the absolute value of which is less than $I_R$. Then, commutation of the current is effected and in a second, spot-mode interval 34 the lamp is operated with a lamp current $I_L$ supplied at an increased current level $I_2$, larger than $I_R$. Thus, the electrode acting as anode in the first interval 32 will likely be switched to spot mode upon application of the high current $I_2$ in the second interval 34, where it operates as cathode. A reverse waveform will likely switch the other electrode to spot mode also.

Experiments have been conducted with HID lamps to show that the waveform 30 is effective for switching a lamp previously operated in diffuse mode to spot mode. This, as explained in view of FIG. 7, is of course only possible if the lamp is generally operated in coexistence region B. Depending on the components of circuit 20, it is possible that the ideal waveform (solid line) may not be obtained, but that an actual measured current curve may look more like the dashed line shown in FIG. 4. Still, the purpose of cooling an electrode and then switching it to spot mode will be fulfilled.

In the waveform 30, referred to as a waveform of alternating DC levels, each DC phase 32, 34 should be longer than a full period of the lamp current $I_L$ during regular supply as a square wave. The absolute value of $I_I$ should be between 50 and 80% of $I_R$ and the absolute value of $I_2$ should be between 120 and 150% of $I_R$. As shown in FIG. 4, the waveform 30 is preferably symmetrical, i. e. the duration of the first and second intervals 32, 34 is about equal and $I_2$ is larger than $I_R$ by the same amount that $I_1$ is less than $I_R$. Thus, in time average, the current supply during the waveform 30 will be equal to $I_R$. A reduced light output during the first interval 32 and increased luminous flux during the second interval 34 may still be measurable, but in view of the short duration should not be found disturbing by an observer.

Alternatively to the above described waveform of alternating DC levels (FIG. 4), the effect of a spot-enforcing waveform may be obtained also by differently shaped current curves. FIG. 5 show a corresponding example of a second embodiment of a spot-enforcing waveform of alternating levels with a cooling interval 32 and a spot-mode interval 34, where the current $I_L$ during each of these intervals is not a (constant or substantially constant) DC current, but may vary along an arbitrary curve. In such cases of the current varying over time, current values $-I_1$ and $1_2$ are average current values. Since the cooling effect on one electrode by a low current will be effected also by a variable current, this waveform will also succeed to switch the electrode to spot mode.

Figure 6:
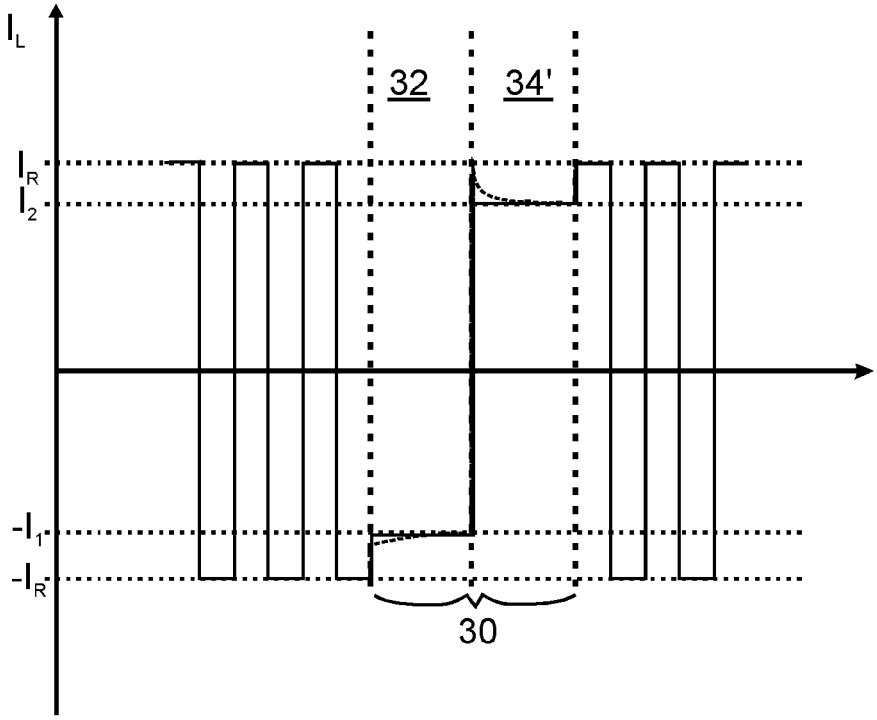

FIG. 6, FIG. 7 show a third and fourth embodiment of spot-enforcing waveforms. While the first and second of such waveforms relied on a cooling interval, followed by a relatively high current after commutation, the third and fourth embodiment shown in FIG. 6, FIG. 7 provide a cooling interval 32 followed by a second interval 34 modified with respect to the first and second waveforms. In the second interval 34' the current after commutation is also at a reduced level, with an absolute value $I_2$ below the run-up current $I_R$. Likewise the varying current during the second interval 34 in the fourth embodiment (FIG. 7) has a lower mean value $I_2$. These waveforms, where the current level $I_2$ after commutation is the same absolute value as the reduced current value $I_1$ before commutation, have also been found effective to switch the lamp to spot mode. However, these waveforms have the disadvantage that the time-average luminous flux is less than during the regular run-up.

FIG. 8 shows a fifth embodiment of a spot-enforcing waveform. A period of the fifth spot-enforcing waveform 40 has a total duration equal to a period of the alternating current supplied at current level $I_R$ before and after the waveform 40 (shown to the left of FIG. 8). In four consecutive intervals 42, 44, 46, 48, the lamp current $I_L$ is supplied at varying current levels $I_1$, $I_2$, $-I_1$, $-I_2$. In a first interval 42, the current is supplied at a current level $I_1$ higher than a current level $I_R$. In a following cooling interval 44, the current is supplied at the lower current level $I_2$, less than $I_R$ by the same amount that the current value $I_1$ is higher than $I_R$. Since in addition the first and second intervals 42, 44 have the same duration, the average current in the first half of the waveform 40 is equal to $I_R$.

The third and fourth intervals 46, 48 are the same as intervals 42, 44 with opposite polarity. The current is first supplied at a high absolute value $-I_1$, and in the following fourth interval 48 the current level $I_2$ again has a relatively low absolute value. As in the first half of the waveform, the third and fourth intervals 46, 48 have the same duration and the current levels are symmetrical around $I_R$, so that the time average current remains at $I_R$.

In FIG. 8, an ideal waveform is shown as a solid line, whereas measured examples may look more like the dotted line shown. Still, both waveforms are effective for switching a first electrode into spot mode by cooling it as an anode in the second interval 44 and applying a high current of reverse polarity in the following interval 46. Since the waveform 40 is symmetrical and is applied continuously multiple times in direct succession, it is also effective to switch the second electrode to spot mode upon transition from the fourth interval 48 to the following first interval 42.

Figure 9:
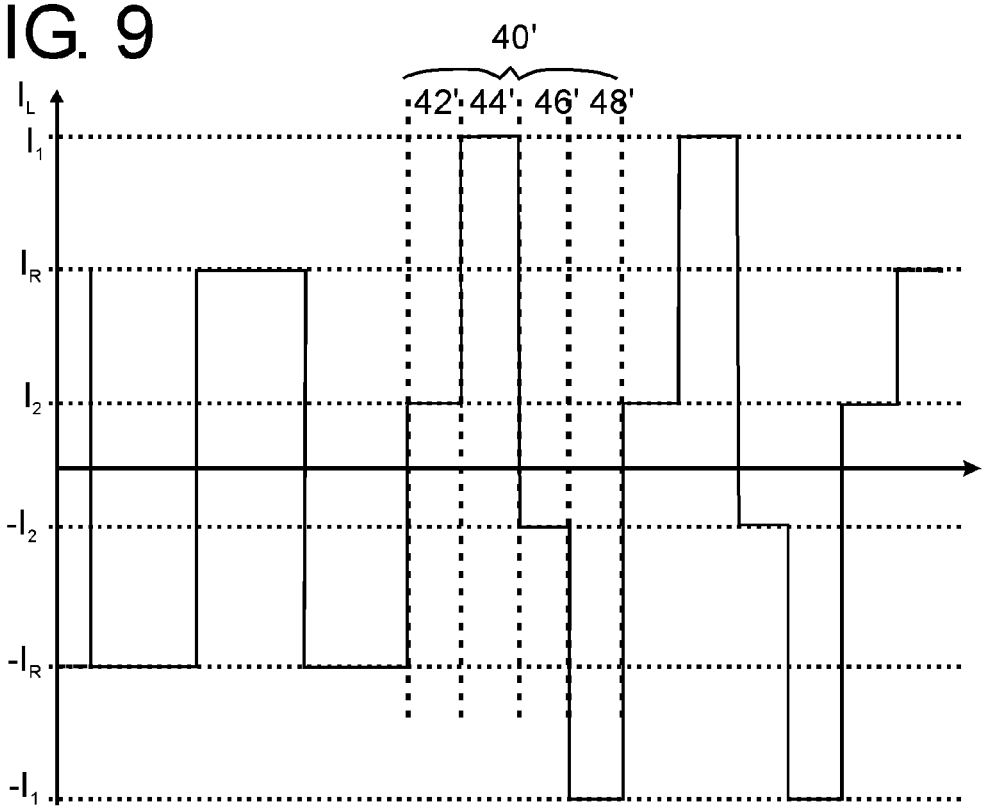

FIG. 9 shows a sixth embodiment of a spot-enforcing waveform. In this waveform, the current, supplied at current level $I_R$ before and after application of the waveform 40'is supplied in four consecutive interval 42', 44', 46', 48' at varying current levels $I_2$, $I_1$, $-I_2$, $-I_1$. The current levels in intervals 42'-48'correspond to the current levels of the fifth embodiment (FIG. 8), but in reverse timely order: The high current value $I_1$, $-I_1$ is applied before commutation, and the lower current value $I_2$, $-I_2$ is applied after commutation. Still, this waveform, due to a reduced current in intervals 44', 48', is effective for cooling the anode sufficiently after application of this modified waveforms several times, such that the lamp is switched into spot mode.

Figure 10:
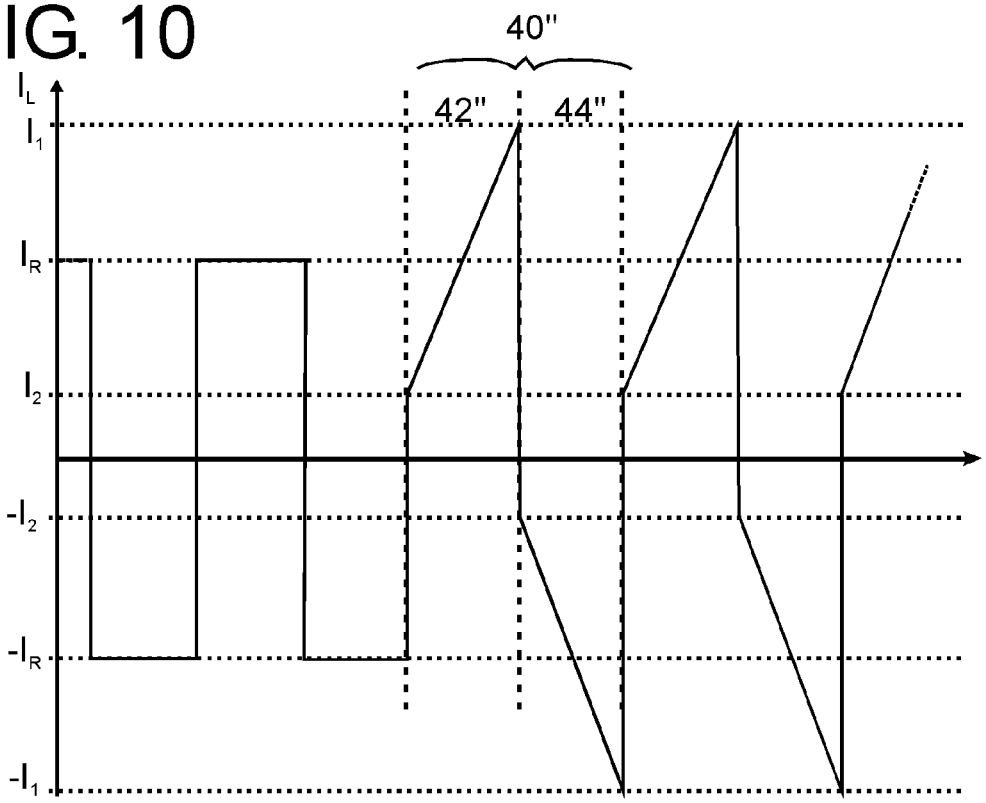

The seventh embodiment of a spot-enforcing waveform shown in FIG. 10 corresponds to the sixth embodiment (FIG. 9), but with current ramps instead of stepwise constant current levels. The repeating waveforms 40" include a first interval 42" with a current linearly increasing from a lower value $I_2$ below the run-up current value $I_R$ to a current value $I_1$, higher than the run-up current value $I_R$. In the following interval 44", the current waveform remains the same, but with opposite polarity. This waveform, also, has been found to be effective for switching the lamp to spot mode.

Also, in all embodiments FIG. 8-FIG. 10, since current levels $I_1$, $I_2$ are chosen symmetrically about the run-up current $I_R$, the average current level remains constant at $I_R$ during application of the repeated waveforms 40, 40', 40", so that the light output remains constant.

As demonstrated by the fact that the embodiments of FIG. 9, FIG. 10 are effective to switch the lamp to spot mode, a sufficient variation of the absolute current is effective as a spot-mode enforcing waveform even if the variation in the absolute current is not synchronous to commutation.

Figure 11A:
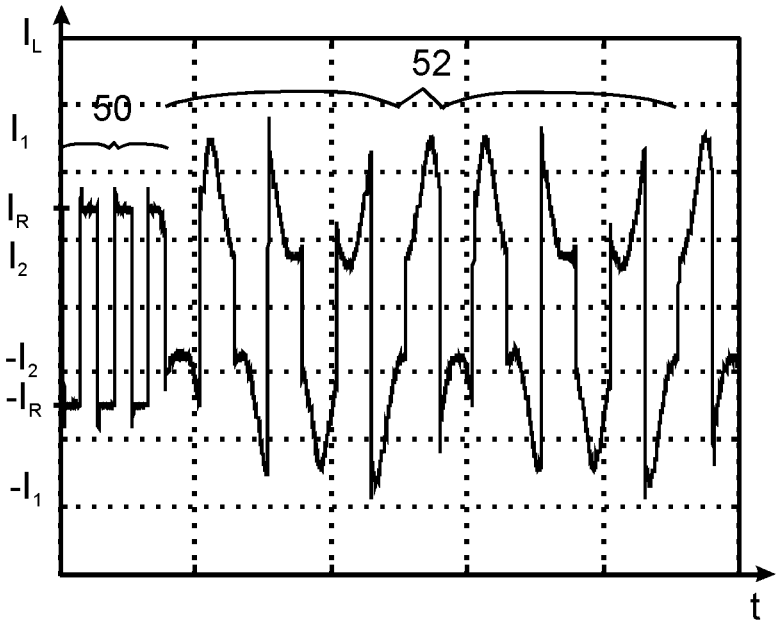
Figure 11B:
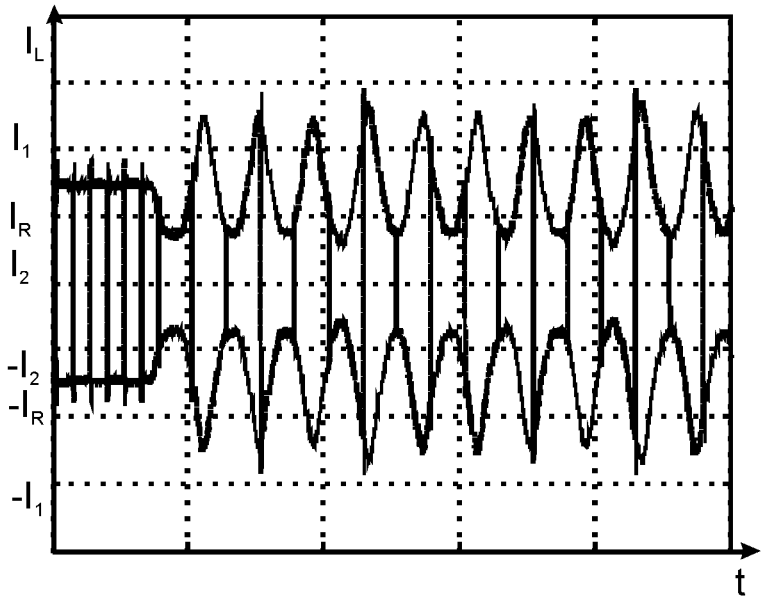

An eighth embodiment of a spot-enforcing waveform, also relying on the fact that a variation of the absolute current level independent of the commutation, is shown in FIG. 11*a*, 11*b*. FIG. 11*a* shows a lamp current $I_L$ supplied to the lamp. To the left of FIG. 11*a*, a portion 50 corresponding to usual run-up current (square wave) is shown, followed by a spot-enforcing waveform 52. The waveform 52 has a continuous modulation of the absolute value of the current supplied. This variation is symmetrical about the current $I_R$ applied during the usual run-up phase 50, and varies between a lower value $I_2$ and a higher value $I_1$. The variation of the absolute current is visible better in FIG. 11*b*, where beside the lamp current $I_L$ also the inverse lamp current $-I_L$ (dotted line) is shown.

In this preferred embodiment, the modulation between $I_1$ and $I_2$ is effected with a modulation frequency of 250 Hz, whereas the commutation frequency during the waveform 52 is 200 Hz. During the usual run-up phase 50, the commutation frequency is 400 Hz. For the purposes of the spot-enforcing waveform 52, the commutation frequency is lowered to 200 Hz, so that the modulation frequency of 250 Hz is higher than the commutation frequency.

While the resulting waveform 52 shown in FIG. 11*a* appears complex, this waveform 52 has proven to be relatively simple to generate in available driver circuits. The apparent light output during the spot-enforcing waveform 52 is constant, since the absolute current value is varied with a frequency of 250 Hz which will not be recognizable to the human eye. Also, the luminous flux during application of the spot-enforcing waveform 52 will be the same as during the usual run-up current 40 applied before and after the spot-enforcing waveform 52, because the modulation is symmetrical about $I_R$, and thus provide the same time-average luminous flux.

Generally, the lower commutation frequency during the spot-enforcing waveform 52 is not necessary to achieve a spot-enforcing effect. However, it is preferred that the modulation frequency is high enough so that the luminous flux is perceived as constant by the human eye, so that modulation frequencies of above 100 Hz, preferably above 200 Hz are preferred. With available driver circuits, however, the achievable modulation frequencies are limited, such as e.g. to 250 Hz. Since the modulation frequency should be higher than the commutation frequency, it is preferred to apply only during the spot-enforcing waveform 52 a lower commutation frequency than during the remaining run-up wave 40.

Figure 3:
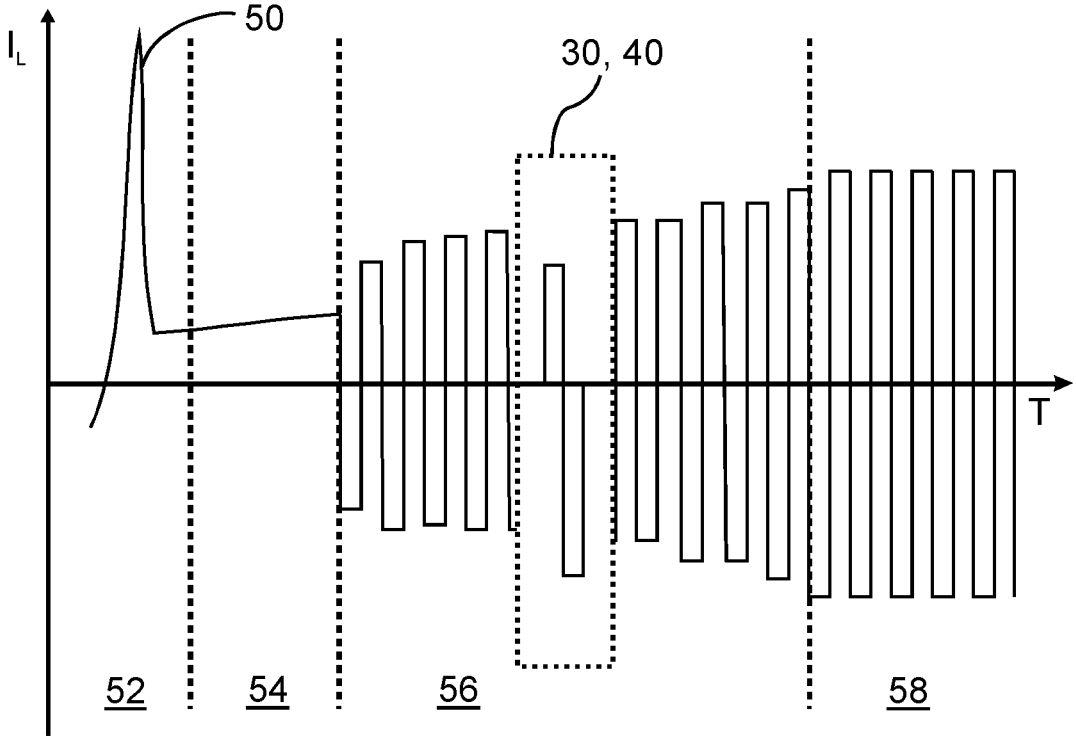
FIG. 3 shows a schematic timing diagram of a lamp current after ignition of a discharge lamp until steady-state operation.

The spot-enforcing waveforms are applied during run-up of the lamp. In the present context, this term refers to a time interval after ignition of the lamp 10 and before the lamp has reached entirely stable steady-state operation. FIG. 3 illustrates schematically the different phases of operation of a discharge lamp after ignition (peak 50). It should be clear that the diagram in FIG. 3 is not drawn to scale, in particular on the time axis. A first ignition phase 52 has a duration of roughly 100 ns, and a following takeover period 54, also referred to as glow-to-arc transition, has a duration of roughly 100 μs.

The present invention deals with the mode of arc attachment once the glow-to-arc transition 54 is complete and a stable arc is present. This is the case at the start of a run-up period 56, during which, as the walls of the discharge vessel heat up and the conditions within the discharge space 18 change, the driver circuit 20 applies a lamp current $I_L$ as a square wave alternating current of the same low frequency as in later steady-state operation 58, but with electrical power or current level controlled to vary over time until thermally stable conditions and full luminous flux is reached in a steady-state region 58, where the driver circuit 20 supplies the lamp current $I_L$ according to control of electrical power to the nominal power value of the lamp 10, e. g. 25 W.

The duration of the run-up period 56 may differ for different types of lamps 10 and for different initial temperatures of the same lamp, i.e. between "cold" and "hot" run-ups, but generally has a duration of about 100 s for cold run-ups.

During the run-up phase 56, a spot-enforcing waveform 30, 40 as shown schematically in FIG. 3 is applied at least once to switch one electrode or both electrodes of the lamp to spot mode in case the spot mode has not been reached naturally by that time.

As explained above in relation to the spot-mode enforcing waveform 30, this is designed to switch one electrode into spot mode. It is of course preferred to also provide a reverse waveform for switching the other electrode into spot mode, too. Since additionally the operating parameters of the arc within the discharge space 18 change while the discharge vessel heats up during the run-up period 56, it is preferred to provide the spot-enforcing waveform multiple times during the run-up interval 56 in order to ensure that the lamp 10 is indeed switched into spot mode at both electrodes 22 as early as possible.

Figure 12:
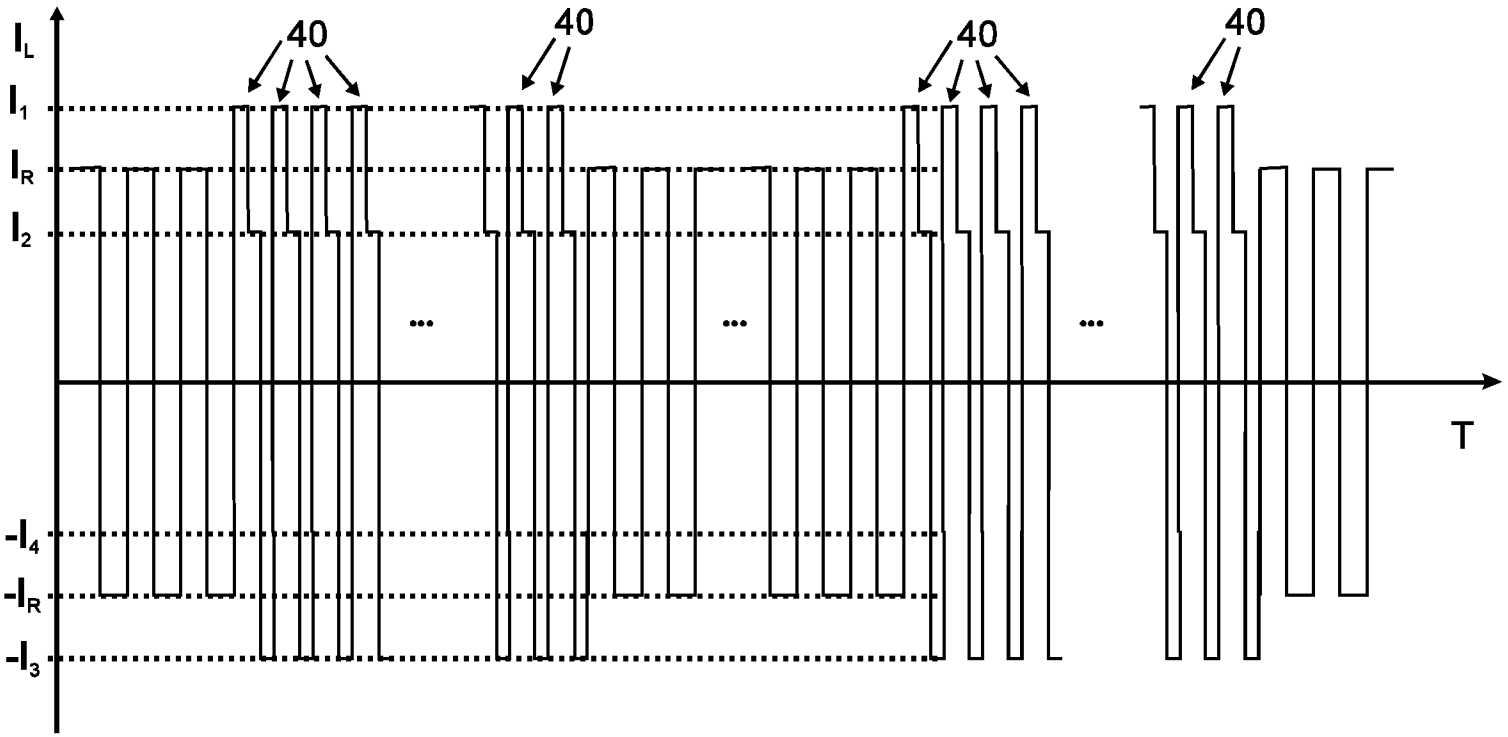
FIG. 12 shows as a schematic timing diagram a lamp current with multiple spot-enforcing waveforms.
Figure 13:
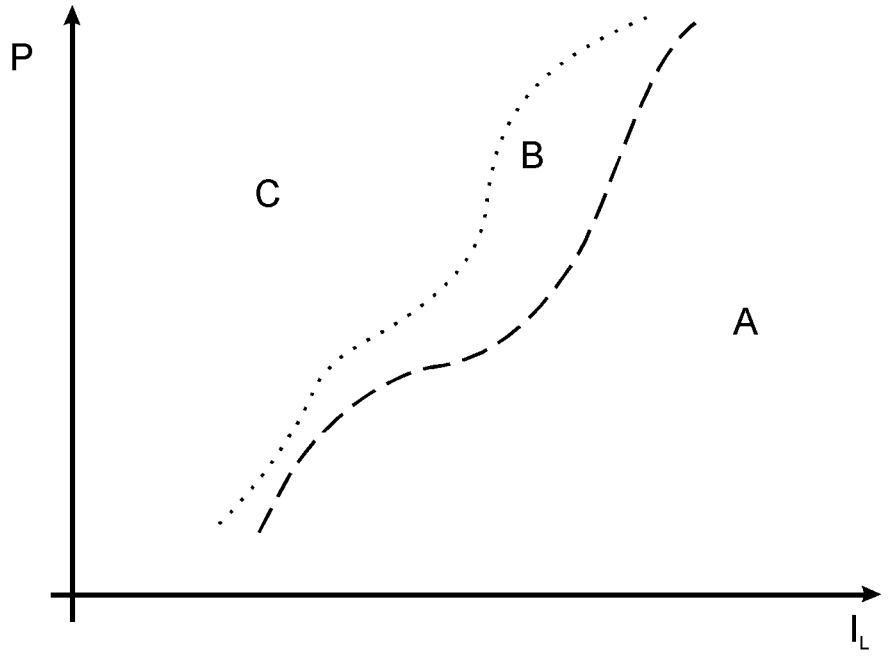
FIG. 13 shows a symbolical diagram of arc attachment mode versus salt pressure p and lamp current $I_L$.

FIG. 12 shows as an example how the preferred spot-enforcing waveform 40 may be applied multiple times during an interval where the lamp is generally driven with a square wave alternating current at a current level $I_R$. It should be noted that for this preferred waveform 40, the driver circuit may continue to supply current at the same level and frequency, and that the waveform 40 may be achieved by superimposing pulses to modify the current levels in the first to fourth intervals of the waveform 40.

Figure 14:
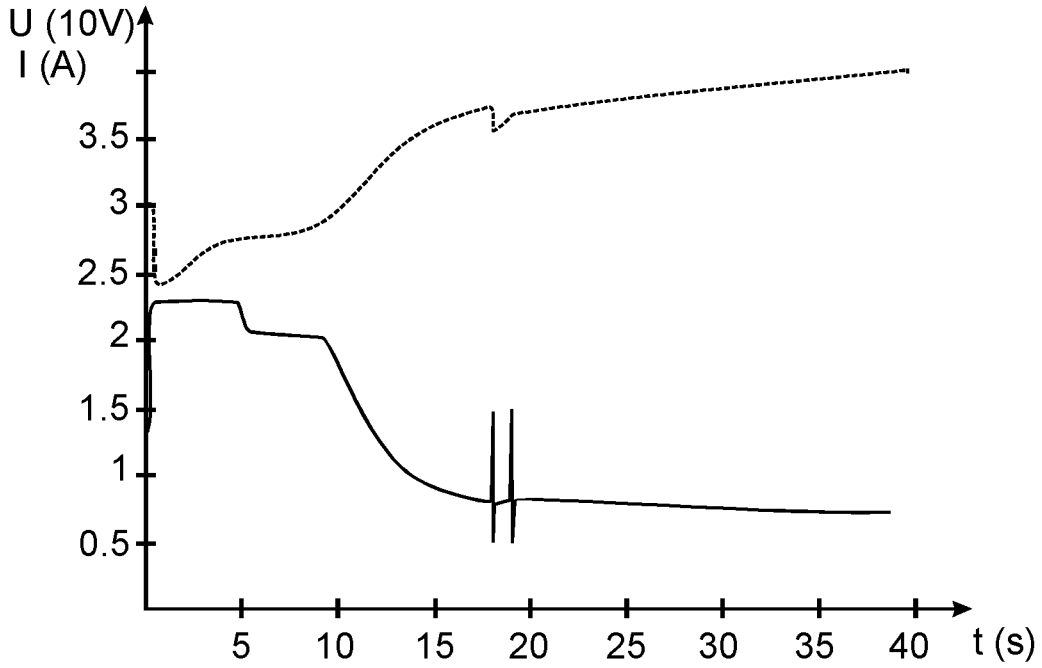
FIG. 14 shows an example of a timing diagram of a lamp current and lamp voltage within a run-up interval.

FIG. 14 shows a timing diagram of a real example of application, where a spot-enforcing waveform is applied during the run-up interval of a lamp. Shown is the lamp current and lamp voltage in the first 40 s of a run-up interval of a Hg-free automotive HID lamp with a rated power of 25 W and thorium-free electrodes.

The current is shown as a full line. Between 0 s (i.e. ignition of the lamp) and about 10 s, the driver keeps the current at two fixed levels of 2.3 A and 2.0 A. From 10 s on, it follows a programmed power curve by imposing a current decrease from 2 A (at 10 s) to about 0.7 A at 40 s. At the same time, the lamp voltage (dashed line) rises from 24V (cold lamp) to near 40V at 40 s. The momentary lamp power at 40 s is 28 W, i.e., the final power of 25 W is not yet reached, but will be reached before 120 s in the present case.

The arc attachment on both electrodes was monitored permanently with a camera. Both electrodes were seen to operate in diffuse mode from the start until 18 s. A spot enforcement waveform of the type shown in FIG. 6 was applied between 18 s and 19 s after start, with the following parameters: average current before spot enforcement I0=0.81 A, levels I1=1.10 A, I2=0.53 A, I3=–I1, I4=–I2. From 19 s onwards, the end of the application inter-val, both electrodes were observed to operate in spot mode. The diffuse-to-spot transition between 18 s and 19 s is manifest also in FIG. 14 by the sudden decrease in lamp voltage by about 1.5V, and by the resulting increase in lamp current (imposed by the driver's power control).

Numerous modifications and variations on the present invention are possible in light of the above teachings. It is therefore to be understood that the invention may be practiced otherwise than as specifically described herein, within the scope of the accompanying claims. In particular the invention may be practiced with different types of discharge lamps, and different spot-enforcing waveforms may be used.

In the claims, the word "comprising" does not exclude other elements or steps, and the indefinite article "a" or "an" does not exclude a plurality. The mere fact that certain measures are recited in mutually different dependent claims does not indicate that a combination of these measures cannot be used to advantage. Any reference signs in the claims should not be construed as limiting the scope.

The invention claimed is:

1. Lighting device including a discharge lamp comprising a sealed discharge space and at least two electrodes arranged within the discharge space to produce an electrical arc, a driver circuit for delivering electrical power to said electrodes, where said driver circuit is disposed to deliver electrical power within a run-up interval after ignition of said arc by supplying an alternating current to said lamp, where during said run-up interval, the waveform of said alternating current is changed at least once to a spot-enforcing waveform, in order to change the mode of attachment of said arc to at least one of said electrodes to a spot mode.

2. Lighting device according to claim 1, where said spot-enforcing waveform is first applied 1-100 s after ignition of said dis-charge lamp.

3. Lighting device according to claim 1, where before applying said spot-enforcing waveform, said alternating current is applied at a run-up current level, where said spot-enforcing waveform comprises at least a cooling interval during which electrical current is supplied to said electrodes at a reduced current level below said run-up current level.

4. Lighting device according to claim 1, where said spot-enforcing waveform comprises a cooling interval during which electrical current is supplied to said electrodes at a first current level with a first polarity such that a first electrode is operated as anode, and a spot mode interval directly after said cooling interval, during which electrical current is supplied to said electrodes at a second current level with opposite polarity such that said first electrode is operated as cathode.

5. Lighting device according to claim 4, where an absolute value of said second current level is higher than an absolute value of said first current level.

6. Lighting device according to claim 1, where before and after applying said spot-enforcing waveform, said current is supplied as an alternating current with a substantially constant run-up current level, where a time average current level during said spot-enforcing waveform is within +/−20% of said run-up current level.

7. Lighting device according to claim 1, where said spot-enforcing waveform comprises at least a first interval, where a current is supplied as a first average current level and a first polarity, and a second interval directly after said first interval, where a current is supplied at a second average current level and a second polarity opposite to said first polarity, where each of said intervals have a duration longer than a period of the alternating current supplied before and after said spot-enforcing waveform.

8. Lighting device to claim 1, where before applying said spot-enforcing waveform, said alternating current is applied at a run-up current level, and where said spot-enforcing waveform is comprises at least one interval, where a current is supplied at a first polarity, and a following interval, where a current is supplied at opposite polarity, where during at least one of said intervals an average current level is lower than said run-up current level, and where said intervals are repeated multiple times.

9. Lighting device to claim 1, where said spot-enforcing waveform comprises at least a first interval, where a current is supplied at a first average current level and a first polarity, a second interval directly after said first interval, where a current is supplied at a second average current level different from said first average current level and with the same polarity, a third interval directly after said second interval, where a current is supplied at a third average current level and a polarity opposite to said first polarity, and a fourth interval directly after said third interval, where a current is supplied at a fourth average current level different from said third average current level and with the same polarity.

10. Lighting device according to claim 9, where said first average current level has an absolute value that is higher than the absolute value of the second average current level, and where an absolute value of said third average current level is higher than an absolute value of said fourth average current level.

11. Lighting device according to claim 10, where before and after said spot-enforcing waveform, said current is supplied as an alternating current with a substantially constant run-up current level, where an absolute value of said first average current level is higher than an absolute value of said run-up current level and an absolute value of said second average current level is less than an absolute value of said run-up current level, and where an absolute value of said third average current level is higher than an absolute value of said run-up current level and an absolute value of said fourth average current level is less than an absolute value of said run-up current level.

12. Lighting device according to claim 11, where during said spot-enforcing waveform, said current is supplied as an alternating current with a commutation frequency lower than during the remaining run-up phase.

13. Lighting device according to claim 1, where during said spot-enforcing waveform, said current is supplied as an alternating current with a commutation frequency, where an absolute value of said current is continuously modulated.

14. Lighting device according to claim 13, where said current is continuously modulated at a modulation frequency higher than said commutation frequency.

15. Method of operating a discharge lamp comprising a sealed discharge space and at least two electrodes, the method comprising:

delivering electrical power to said lamp during a run-up interval after ignition of said lamp by supplying an alternating current to said lamp, during said run-up interval, changing the waveform of said alternating current at least once to a spot-enforcing waveform in order to change the mode of attachment of said arc to said electrodes to a spot mode.

* * * * *